US006728994B1

(12) United States Patent
Rushin, Jr. et al.

(10) Patent No.: US 6,728,994 B1
(45) Date of Patent: May 4, 2004

(54) HANDLE ATTACHMENT

(76) Inventors: Joseph Rushin, Jr., 9324 Daney St., Gotha, FL (US) 34734; Khadijah Bey-Rushin, 9324 Daney St., Gotha, FL (US) 34734

( * ) Notice: Subject to any disclaimer, the term of this patent is extended or adjusted under 35 U.S.C. 154(b) by 0 days.

(21) Appl. No.: 10/295,474

(22) Filed: Nov. 15, 2002

(51) Int. Cl.[7] ..... A45C 13/22
(52) U.S. Cl. ..... 16/426; 16/436; 16/422
(58) Field of Search ..... 16/436, 422, 426; 425/183, 456; 404/102, 114, 118; 15/143.1, 145, 235.4; 280/646, 651–653, 655.1, 47.17, 47.24, DIG. 16

(56) References Cited

U.S. PATENT DOCUMENTS

| | | | | | |
|---|---|---|---|---|---|
| 4,256,416 | A | | 3/1981 | Bishop | |
| 4,650,366 | A | | 3/1987 | Morrison | |
| 4,752,156 | A | * | 6/1988 | Owens | 404/118 |
| 4,828,427 | A | | 5/1989 | Nisenbaum | |
| 4,838,730 | A | * | 6/1989 | Owens | 404/114 |
| 5,016,319 | A | | 5/1991 | Stigen | |
| 5,046,387 | A | * | 9/1991 | Levake | 81/489 |
| D327,616 | S | | 7/1992 | Owens | |
| 5,244,305 | A | * | 9/1993 | Lindley | 404/97 |
| 5,324,085 | A | | 6/1994 | Hintz, Jr. | |
| 5,488,259 | A | * | 1/1996 | Cho | 310/91 |
| 5,605,415 | A | * | 2/1997 | Shamblin | 404/118 |
| 5,683,093 | A | * | 11/1997 | Hayes | 280/293 |
| 5,857,803 | A | * | 1/1999 | Davis et al. | 404/102 |
| 5,873,147 | A | * | 2/1999 | Hintz | 16/426 |
| 5,980,154 | A | * | 11/1999 | Record | 404/97 |
| 6,200,065 | B1 | * | 3/2001 | Eitzen | 404/114 |
| 6,349,958 | B1 | * | 2/2002 | Gawlik | 280/293 |

* cited by examiner

*Primary Examiner*—Chuck Y. Mah

(57) ABSTRACT

A new handle attachment for attaching to a screed to aid in the leveling of freshly laid concrete. The inventive device includes an elongate shaft with a handle portion extended from one end of the shaft and a pair of arms extending from another end of the shaft. Each of the arms has a slot therein which are designed for receiving an item, such as a screed therein.

7 Claims, 2 Drawing Sheets

10
12
14
15
16
17
18
19
20
21
22
23
24
25
26
27
1
3
4

FIG.3
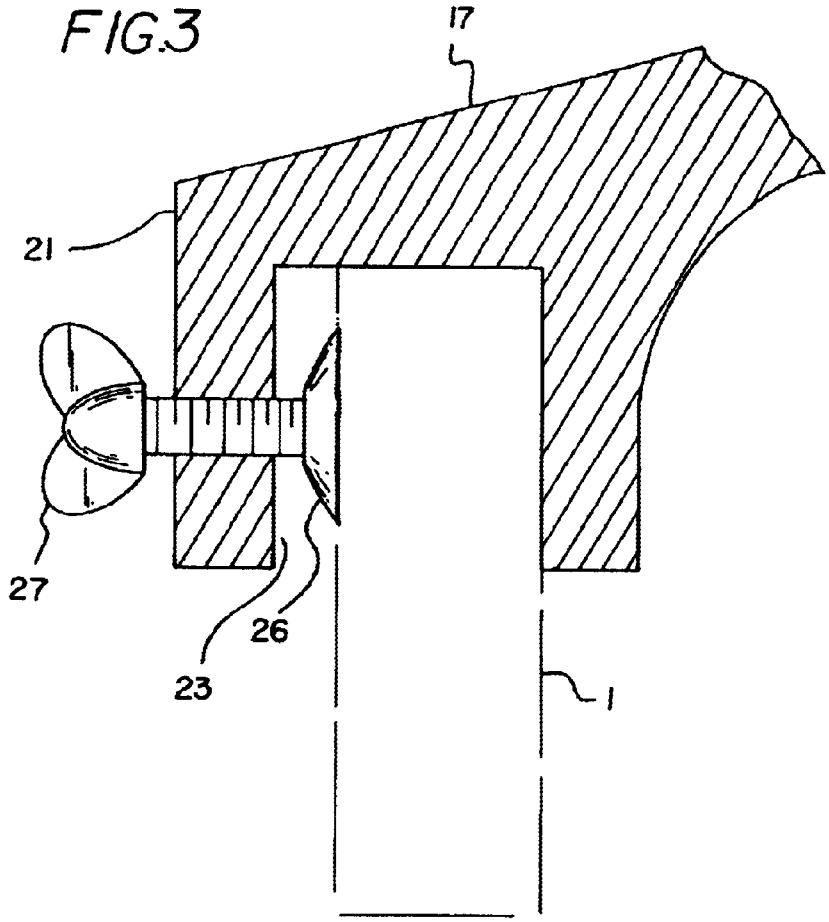
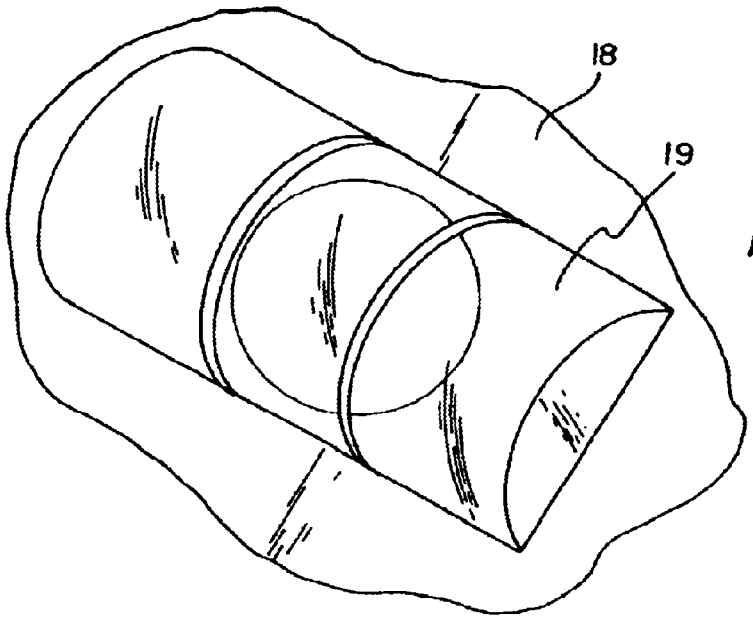
FIG.4

HANDLE ATTACHMENT

BACKGROUND OF THE INVENTION

1. Field of the Invention

The present invention relates to concrete working tools and more particularly pertains to a new handle attachment for attaching to a screed to aid in the leveling of freshly laid concrete.

2. Description of the Prior Art

The use of concrete working tools is known in the prior art. More specifically, concrete working tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art concrete working tools include U.S. Pat. No. 5,016,319; U.S. Pat. No. 5,324,085; U.S. Pat. No. Des. 327,616; U.S. Pat. No. 4,650,366; U.S. Pat. No. 4,256,416; and U.S. Pat. No. 4,828,427.

While these devices fulfill their respective, particular objectives and requirements, the aforementioned patents do not disclose a new handle attachment. The inventive device includes an elongate shaft with a handle portion extended from one end of the shaft and a pair of arms extending from another end of the shaft. Each of the arms has a slot therein which are designed for receiving an item, such as a screed therein.

In these respects, the handle attachment according to the present invention substantially departs from the conventional concepts and designs of the prior art, and in so doing provides an apparatus primarily developed for the purpose of attaching to a screed to aid in the leveling of freshly laid concrete.

SUMMARY OF THE INVENTION

In view of the foregoing disadvantages inherent in the known types of concrete working tools now present in the prior art, the present invention provides a new handle attachment construction wherein the same can be utilized for attaching to a screed to aid in the leveling of freshly laid concrete.

The general purpose of the present invention, which will be described subsequently in greater detail, is to provide a new handle attachment apparatus and method which has many of the advantages of the concrete working tools mentioned heretofore and many novel features that result in a new handle attachment which is not anticipated, rendered obvious, suggested, or even implied by any of the prior art concrete working tools, either alone or in any combination thereof.

To attain this, the present invention generally comprises an elongate shaft with a handle portion extended from one end of the shaft and a pair of arms extending from another end of the shaft. Each of the arms has a slot therein which are designed for receiving an item, such as a screed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handle attachment apparatus and method which has many of the advantages of the concrete working tools mentioned heretofore and many novel features that result in a new handle attachment which is not anticipated, rendered obvious, suggested, or even implied by any of the prior art concrete working tools, either alone or in any combination thereof.

It is another object of the present invention to provide a new handle attachment which may be easily and efficiently manufactured and marketed.

It is a further object of the present invention to provide a new handle attachment which is of a durable and reliable construction.

An even further object of the present invention is to provide a new handle attachment which is susceptible of a low cost of manufacture with regard to both materials and labor, and which accordingly is then susceptible of low prices of sale to the consuming public, thereby making such handle attachment economically available to the buying public.

Still yet another object of the present invention is to provide a new handle attachment which provides in the apparatuses and methods of the prior art some of the advantages thereof, while simultaneously overcoming some of the disadvantages normally associated therewith.

Still another object of the present invention is to provide a new handle attachment for attaching to a screed to aid in the leveling of freshly laid concrete.

Yet another object of the present invention is to provide a new handle attachment which includes an elongate shaft with a handle portion extended from one end of the shaft and a pair of arms extending from another end of the shaft. Each of the arms has a slot therein which are designed for receiving an item, such as a screed therein.

Still yet another object of the present invention is to provide a new handle attachment that can also be used to level dirt, gravel and sand.

Even still another object of the present invention is to provide a new handle attachment that can be attached to an elongate sponge or a cloth and be used as a mop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic sectional view of the present invention taken from line 3—3 of FIG. 1.

FIG. 4 is a schematic partial perspective view of the bubble vial of the present invention as taken from the circle 4 on FIG. 1.

DESCRIPTION OF THE PREFERRED EMBODIMENT

Figures 1, 2:
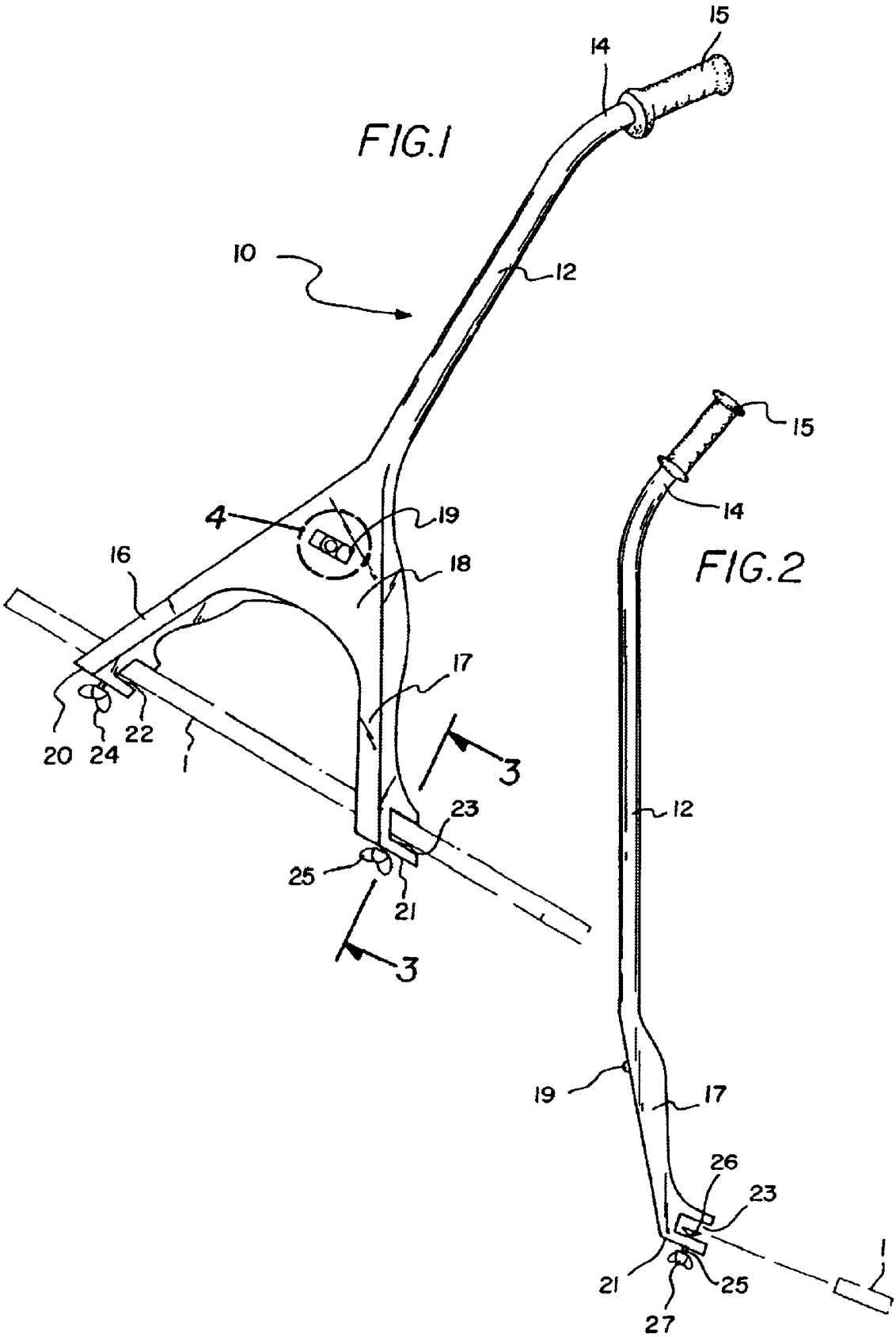
FIG. 1 is a schematic perspective view of a new handle attachment in use holding a screed according to the present invention.
FIG. 2 is a schematic side view of the present invention.

With reference now to the drawings, and in particular to FIGS. 1 through 4 thereof, a new handle attachment embodying the principles and concepts of the present invention and generally designated by the reference numeral 10 will be described.

The handle attachment 10 is designed for attachment to an generally rectangular elongate screed 1, or strike-off board, so that the screed 1 can be held at a comfortable distance from a user. As best illustrated in FIGS. 1 through 4, the handle attachment 10 generally comprises an elongate shaft 12 with a handle portion 14 extended from one end of the shaft 12 and a pair of arms 16,17 extending from another end of the shaft 12. Each of the arms 16,17 has a slot therein which are designed for receiving an item, such as a screed 1 therein.

In closer detail, the handle attachment 10 is generally Y-shaped. The elongate shaft 12 has a pair of opposite ends and a longitudinal axis extending between the ends of the shaft 12. The handle portion 14 extends from one of the ends of the shaft 12. The handle portion 14 also has a longitudinal axis. The longitudinal axis of the handle portion 14 preferably extends at an obtuse angle in a first direction from the longitudinal axis of the shaft 12. Ideally, the handle portion 14 also includes a hand grip 15 for aiding the grip of a user holding the handle portion 14.

The pair of arms 16,17 are extended from the other end of the shaft 12 so that the arms 16,17 define a generally V-shaped space between them. Preferably, the arms 16,17 form a root portion 18 adjacent the other end of the shaft 12. The root portion 18 is ideally generally triangular in shape and has a bubble vial 19 provided on it. The bubble vial 19 is designed for helping a user determine the levelness of the arms 16,17 when the arms 16,17 are resting on a surface such as when the attachment 10 is used with a screed 1 to level freshly laid concrete. Preferably, the arms 16,17 lie an a plane that is extended at an obtuse angle in the first direction from the longitudinal axis of the shaft 12. Ideally, the obtuse angle formed by the arms 16,17 and the shaft 12 is greater than the obtuse angle formed by the handle portion 14 and the shaft 12.

Each of the arms 16,17 has a free end 20,21 extending away from the other end of the shaft 12 such that the free ends 20,21 are spaced apart from each other. Each of the arms 16,17 has a slot therein which face in the first direction in which the arms and handle portion are extended away from the longitudinal axis of the shaft. Preferably, the slots 22,23 are located adjacent the free end 20,21 of their associated arm 16,17. Ideally, the slots 22,23 each have a generally rectangular U-shaped cross-section. The slots 22,23 are designed for receiving an item, such as a portion of a screed 1, therein. Each of the free ends 20,21 of the arms 16,17 has a threaded clamping bolt 24,25 extending into the associated slot 22,23. The clamping bolts 24,25 are designed for holding an item, such as a screed 1 inserted into the associated slot to the associated arm. With reference to FIG. 3, each of the clamping bolts 24,25 has a clamping pad 26 in the associated slot and an external turning head 27 for tightening the clamping bolt to hold the screed in the slot.

In an ideally illustrative embodiment, the handle attachment 10 has a length of less than about 5 feet. Preferably, the shaft 12 and handle portion 14 have a combined length of less than 3 feet, and the arms 16,17 have a length from the other end of the shaft 12 to the free end of less than about 2 feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A handle attachment for attachment to an elongate screed, said handle attachment comprising:

an elongate shaft having a pair of opposite ends and a longitudinal axis extending between said ends of said shaft;

a handle portion being extended from one of said ends of said shaft, said handle portion having a longitudinal axis;

a pair of arms being extended from another of said ends of said shafts said arms form a root portion adjacent said other end of said shaft;

each of said arms having a slot therein, each of said slots being adapted for receiving an item therein; and a bubble vial position on a top surface of said root portion facilitating visual observation of said bubble vial unobstructed by a hand and arm of a user.

2. The handle attachment of claim 1, wherein said longitudinal axis of said handle portion is extended at an obtuse angle from said longitudinal axis of said shaft.

3. The handle attachment of claim 1, wherein said root portion is generally triangular.

4. The handle attachment of claim 1, wherein each of said arms has a free end, said free ends of said arms being spaced apart from each other, and wherein said slots are located adjacent said free end of the associated arm.

5. The handle attachment of claim 4, wherein each of said free ends of said arms has a clamping bolt being extended into the associated slot, said clamping bolts being for holding an item inserted into the associated slot to the associated arm.

6. The handle attachment of claim 1, wherein said arms lie an a plane being extended at an obtuse angle from said longitudinal axis of said shaft.

7. A handle attachment for attachment to an elongate screed, said handle attachment comprising:

an elongate shaft having a pair of opposite ends and a longitudinal axis extending between said ends of said shaft;

a handle portion being extended from one of said ends of said shaft, said handle portion having a longitudinal axis, said longitudinal axis of said handle portion being extended at an obtuse angle from said longitudinal axis of said shaft;

a pair of arms being extended from another of said ends of said shaft, said arms defining a space therebetween;

said arms forming a root portion adjacent said other end of said shaft, said root portion being generally triangular;

a bubble vial being provided on said root portion, said bubble vial position on a top surface of said root portion facilitating visual observation of said bubble vial unobstructed by a hand and arm of a user;

each of said arms having a free end, said free ends of said arms being spaced apart from each other;

wherein said arms lie an a plane being extended at an obtuse angle from said longitudinal axis of said shaft;

each of said arms having a slot therein, said slots being located adjacent said free end of the associated arm, said slots each having a generally rectangular U-shaped cross-section, each of said slots being adapted for receiving an item therein; and each of said free ends of said arms having a clamping bolt being extended into the associated slot, said clamping bolts being for holding an item inserted into the associated slot to the associated arm.

* * * * *